US008052293B2

(12) United States Patent
Hurwitz

(10) Patent No.: US 8,052,293 B2
(45) Date of Patent: Nov. 8, 2011

(54) OMNIDIRECTIONALLY ILLUMINATED SPORT BOARD

(75) Inventor: Marni Markell Hurwitz, Far Hills, NJ (US)

(73) Assignee: Nite Glow Industries, Inc., Far Hills, NJ (US)

( * ) Notice: Subject to any disclaimer, the term of this patent is extended or adjusted under 35 U.S.C. 154(b) by 0 days.

(21) Appl. No.: 11/903,006

(22) Filed: Sep. 20, 2007

(65) Prior Publication Data

US 2011/0211363 A1 Sep. 1, 2011

(51) Int. Cl.
*F21V 33/00* (2006.01)

(52) U.S. Cl. ..... 362/84; 362/253; 362/276

(58) Field of Classification Search ..... 362/84, 362/253, 276, 802, 459, 546; 280/87.042, 280/816

See application file for complete search history.

(56) References Cited

U.S. PATENT DOCUMENTS

| | | | | |
|---|---|---|---|---|
| 4,336,573 | A | 6/1982 | Carter | 362/459 |
| 5,119,277 | A | 6/1992 | Copley et al. | 362/543 |
| 5,132,883 | A | 7/1992 | La Lumandier | 362/466 |
| 5,292,141 | A | 3/1994 | Ekedal et al. | 280/87.042 |
| 5,513,080 | A | 4/1996 | Magle et al. | 362/103 |
| 5,876,108 | A * | 3/1999 | Chien | 362/35 |
| 6,431,733 | B2 * | 8/2002 | Seifert et al. | 362/459 |
| 6,802,636 | B1 | 10/2004 | Bailey, Jr. | 362/555 |
| 7,048,284 | B1 | 5/2006 | Seifert | 280/79.11 |
| 2002/0135464 | A1 * | 9/2002 | Chiu | 340/321 |
| 2004/0100055 | A1 | 5/2004 | Chang | 280/87.042 |
| 2004/0257831 | A1 | 12/2004 | Liao | 362/565 |
| 2005/0029767 | A1 | 2/2005 | Chang | 280/87.042 |
| 2005/0102733 | A1 | 5/2005 | Holmberg et al. | 2/171 |

* cited by examiner

*Primary Examiner* — Thomas Sember

(74) *Attorney, Agent, or Firm* — Ernest D. Buff; Ernest D. Buff & Associates, LLC

(57) ABSTRACT

An illuminated sport board/skateboard emits light from both the top and bottom of the board to yield a significant quantum of light for optimal visibility and safety. A base panel is provided having an underside surface with at least one transparent segment aligned with an inlay cavity within the base's interior core. A battery powered lighting source containing a plurality of light emitting diodes or an electroluminescent lighting strip is housed within the inlay cavity. A top shell having at least one transparent display is attached to the base panel in a manner that aligns the transparent display with the LED emitted or electroluminescent lighting. Light is emitted from both the top and bottom of the board owing emission through the transparent display of the top shell and the transparent segment of the base panel. The illuminated sport board may be constructed as a skateboard, snowboard, or skis to provide safety from vehicles and other recreational participants.

31 Claims, 5 Drawing Sheets

OMNIDIRECTIONALLY ILLUMINATED SPORT BOARD

BACKGROUND OF THE INVENTION

1. Field of the Invention

The present invention relates to an illuminated sport/recreation board; and more particularly, to a skateboard illuminated with electroluminescent characters, indicia and/or decorations suited for use during dusk or nighttime hours for enhanced safety.

2. Description of the Prior Art

Skateboarding during dusk or nighttime hours can be hazardous on roadways and/or in neighborhoods where automobiles are encountered. Illuminating characteristics of automobile headlamps generally produce an illumination range of approximately 25 to 50 feet. This illumination range can be significantly reduced by mist, fog, or bends in the road. Despite improvements to vehicle headlights, skateboarders, and the like, are oftentimes not seen by automobile drivers until the distance between the automobile and the skateboarder is small and chances for avoiding contact are significantly reduced. Moreover, skateboarders and other sport boarders, such as snowboarders and skiers, run the risk of colliding into one another due to poor visibility during dimly lit conditions. It would further be advantageous if the sport board included light visibility on the surface thereof so that the skateboarder could readily glance down during skating and access his/her feet positions, while at the same time providing visibility from the underside of the board when the board is in the air during a stunt.

Several approaches devised by prior art workers attempt to provide solutions for these hazardous visibility conditions. These approaches include providing sport boards/skateboards having lighting elements located on the periphery or the side of the board. For example: U.S. Pat. No. 7,048,284 to Seifert discloses an illuminated skateboard including a light string mounted about a peripheral edge of a deck extending between a top surface and a bottom surface of a board; U.S. Pat. No. 6,802,636 to Bailey, Jr. discloses an illuminated recreational board including a plurality of recesses with a transparent cover extending in a peripheral side of a board and a plurality of removable LED's positioned therein; U.S. Pat. No. 5,132,883 to La Lumandier discloses an illuminated railing with a bar of lights appointed for attachment to a skateboard as a bumper; U.S. Patent Application Publication No. 20040257831 to Liao discloses an illuminating decoration for a skateboard including two transparent tubes with a plurality of light-emitting elements therein that are attached to two lateral sides of a skateboard; and U.S. Patent Application Publication No. 20050029767 to Chang discloses a skateboard with a plurality of LEDs are embedded in a periphery of the board and are arranged so that when the wheels rotate, light is emitted from the LEDs. These types of peripheral lighting applications on skateboards/sport boards do not provide a significant degree of light for visibility; nor does the peripheral lighting allow the skater to readily assess the exact position of his/her feet in dark or dimly lit surroundings, since the lights are only on the periphery. In such cases, light is only emitted from the peripheral or sides of the board. As a result, the board is not optimally visible from vantage points above the board, or from beneath the board during air-borne stunts.

Various types of sport boards and skateboards having illumination emitting capabilities have been provided wherein illumination means is attached to the underside of a board, thereby only providing illumination directly under the board and not above the board surface. For example: U.S. Pat. No. 4,336,573 to Carter discloses an illuminated skate/skateboard including a person carrying platform having a light source on the underside thereof for underside illumination, and wheels formed of translucent material capable of transmitting light generated by the light source; U.S. Pat. No. 5,292,141 to Ekedal, et al. discloses a skateboard comprising riding platform with a rotatable disk for maneuverability supported thereon, and optional front and rear illumination sources mounted within respective housings secured to the underside of the riding platform; U.S. Pat. No. 5,119,277 to Copley, et al. discloses an illuminated skateboard comprising a riding platform having a bottom surface with front and rear housing secured thereto, wherein the front and rear housing each include an illumination source therein operable to provide illumination while riding the skateboard; and U.S. Patent Application Publication No. 20040100055 to Chang discloses a skateboard having a step board with wheels and a truck unit appointed with a safety alert system underneath the step board and at least one illuminator positioned at an exterior of the truck unit. Like the intended disadvantageous faced by the peripheral lighting applications, these underside lighting skateboards do not provide a significant degree of light for visibility; nor does the peripheral lighting allow the skater to readily see the exact position of his/her feet when dark as the lights are only on the periphery. Light only emits from the underside of the skateboard, and/or the wheels (in limited disclosures), and as a result, the board is not optimally visible from vantage points above the board thereby causing risk of the skateboarder being struck by a vehicle or colliding with another skateboarder.

Other illuminated skateboards provide illumination to more than a simple underside or periphery of a skateboard. However these boards still fail to provide electroluminescent lighting integrated within the board so that a substantial area of the board omnidirectionally emits light therefrom. U.S. Pat. No. 5,513,080 to Magle, et al. discloses a lighting kit that provides indirect lighting for roller skates or skateboards by mounting a lighting assembly under the shoe section of the skate or underside of the skateboard and providing a light directed down from the bottom of the shoe section of the skate or underside of the skateboard to the floor under the user. Further disclosed are the use of flat EL lamp panels provided for removable attachment to the sides of a skateboard. The flat EL lamp panels are applied to the outside of the board, and therefore may begin to malfunction and lose integrity over time as exposed to inclement weather, rain, snow, etc. Over time the lamp panels would likely become damaged as they may be stepped on or otherwise damaged as they are on the exterior of the board.

Even where illuminated skateboards heretofore disclosed and utilized provide lighting integrated within the board, these devices still fail to provide illumination to a substantial area of the board to virtually omnidirectionally emit light therefrom. U.S. Patent Application Publication No. 20050102733 to Holmberg, et al. discloses lighted sports equipment comprising a skateboard including a tip portion, a waist portion, and a tail portion, wherein each are selectively illuminable, being responsive to at least one illumination means provided within the skateboard. The tip portion, waist portion, and tail portion may each be constructed at least in part from a translucent material. Despite the use of selective illumination on the tip, waist or tail portion, these devices still fail to provide lighting integrated within the board so that a substantial area of the board omnidirectionally emits light therefrom. The board does not provide for omnidirectional lighting, in that only the top of the board is provided with illumination; while the underside of the board is not.

Notwithstanding the efforts of prior art workers to construct illuminated skateboards/sport boards that provide safety during nighttime use, there remains a need in the art for an illuminated sport board/skateboard that emits a significant quantum of light for optimal visibility and safety. There exists a need in the art for an illuminated sport board that provides emission of light over substantially the entire surface of the board, including light emission from the top and bottom of the board, so that the light is emitted in an omnidirectional manner and is visible from virtually every position. Visibility of the individual using the board would be enhanced if light was emitted, not just from a thin band extending peripherally around a board, but from a plurality of segments located on the top and bottom of a sport/skateboard.

SUMMARY OF THE INVENTION

The present invention provides an illuminated sport board/skateboard that emits light from both the top of the board and the bottom in a manner that yields a significant quantum of light for optimal visibility and safety. As a result, the user of the board is visible from virtually every position and the safety of the board user is enhanced when dealing with vehicles as well as other persons carrying out related or like recreational activities. Visibility of the individual using the board is enhanced as light is emitted, not just from a thin band circumferentially around the board or a small rear or front spot, but from a plurality of segments located on the top and on the underside/bottom of the board. This virtual omnidirectional emission of light from the board is achieved by providing a base panel having at least one transparent segment and a top shell having at least one transparent display located on each of the underside and top of the board, respectively.

The illuminated sport board comprises a base panel having sides, an underside surface, upper surface, and interior core. The upper surface includes an opening therein that extends within the interior core of the base panel to form an inlay cavity therein. This inlay cavity may take a plethora of shapes and forms, but preferably it is a channel type construct. The underside of the base panel has at least one transparent segment that is aligned with the inlay cavity. The board further comprises a lighting source housed within the inlay cavity of the base panel. The light source can comprise a plurality of light emitting diodes, and preferably comprises at least one electroluminescent light strip. As such, the light source will hereinafter be described as an electroluminescent lighting source. A top shell having at least one transparent display is included as a feature of the board. The top shell is attached to the upper surface of the base panel so that the transparent display is aligned with the electroluminescent lighting strip within the inlay cavity for emitting light from the transparent display. A battery activated by a power control for supplying current to the electroluminescent light source is provided. The electroluminescent lighting source emits light through the transparent display of the top shell and the transparent segment of the underside surface of the base panel so that the sport board is highly visible. The illuminated sport board may further include wheels attached to the underside surface of the base panel to form a skateboard device. Alternatively, the sport board is constructed for use as a snowboard or in for use as skis.

A method of manufacturing an illuminated sport board is provided. The first step involves forming a base panel. The base panel comprises sides, an underside surface, upper surface, and interior core. The underside has at least one transparent segment. Next, illumination designs are selected and are aligned on the upper surface of the base panel and are cut, etched, or the like to form an opening traversing into an inlay cavity. This inlay cavity carved or otherwise formed in the base panel is aligned with the transparent segment of the base panel. An electroluminescent lighting strip is then sized and shaped to correspond with the illumination designs of the inlay cavity and same is then placed within the inlay cavity of the base panel. The next step involves cutting a compartment into the interior core of the base panel and fitting a battery with a power control therein and connecting same to the electroluminescent lighting strip. Subsequently, a top shell is formed. The top shell has at least one transparent display shaped as the illumination designs. This top shell is aligned with the base panel and visa vie the transparent display is aligned with the inlay cavity and electroluminescent light strip and is attached to the base panel. In operation, the electroluminescent lighting source emits light through the transparent display of the top shell and the transparent segment of the underside surface of the base panel so that the sport board is highly visible from both top and bottom views.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention provides an illuminated sport board that emits light along a substantial portion of the surface of the board, including the top and the bottom thereof. A base panel is provided having an inlay cavity in the interior thereof and at least one transparent segment on the underside thereof aligned with the inlay cavity. A light source is positioned and housed within the inlay cavity. The light source can comprise a plurality of light emitting diodes, and preferably comprises an electroluminescent strip. A top shell is then attached to the upper surface of the base panel, substantially sealing the inlay cavity, and light source therein, so that the resultant board is durable and resilient when used during recreational/sporting activities. This top shell includes at least one transparent display, preferably intermingled with opaque sections or regions throughout the entire surface, and aligned with the light source so that the transparent displays emit light therefrom. Additionally, the transparent segments of the base panel emit light therefrom, so that light is emitted from virtually the entire surfaces, top and bottom, of the board and the board can be seen from any vantage point. This increases the margin of safety in dusk or night time environments when a vehicle is approaching by illuminating the board from substantially all angles, while at the same time enhancing visibility on tracks or slopes to minimize the risk of collisions with others.

Figure 1A:
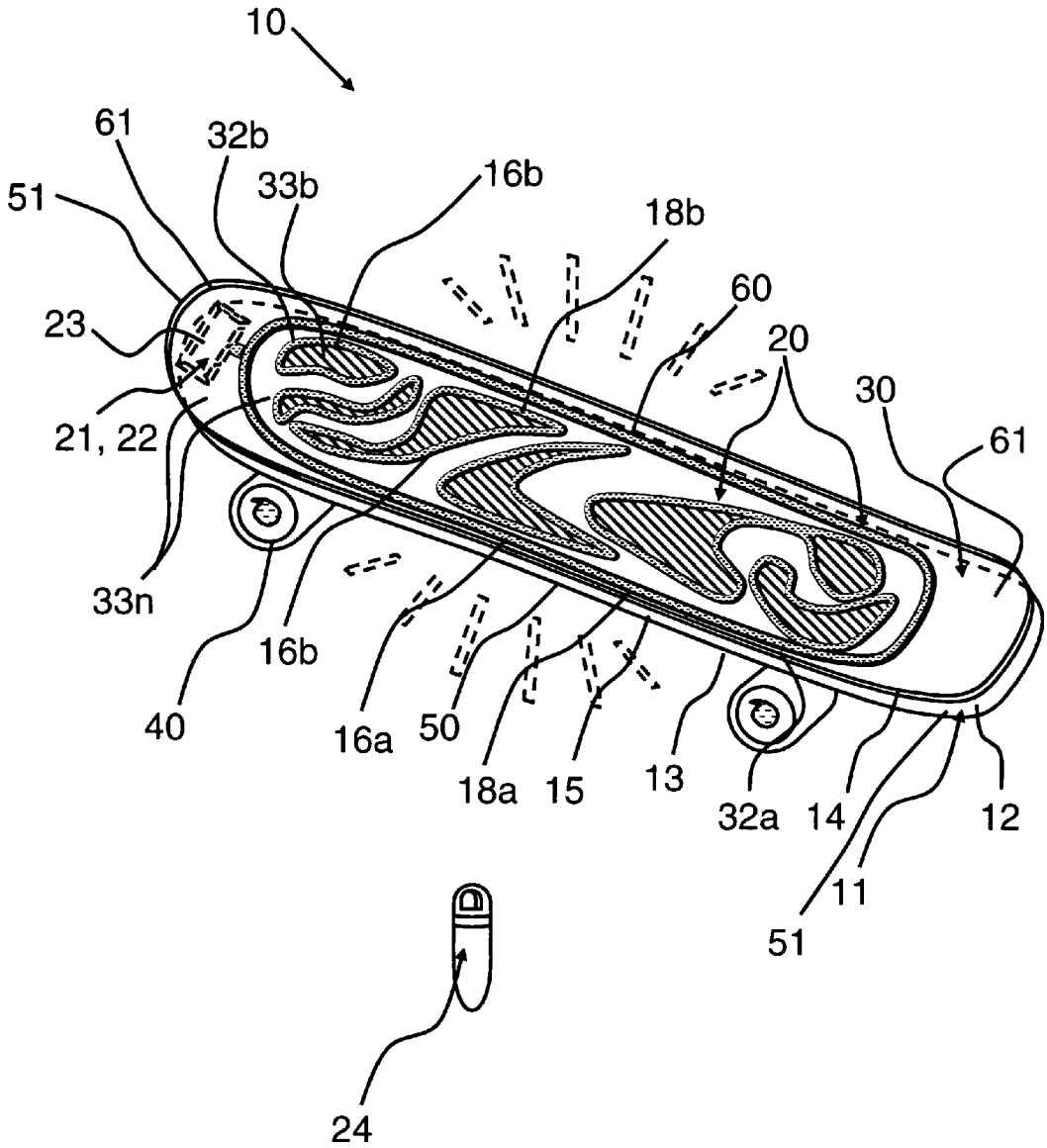
FIG. 1*a* is a top view of the sport board wherein the electroluminescent lighting source is supplied with current so that the board is in the "on" or illuminated condition with light emitting from the transparent displays of the top shell and the transparent segment of the base panel.
Figure 1B:
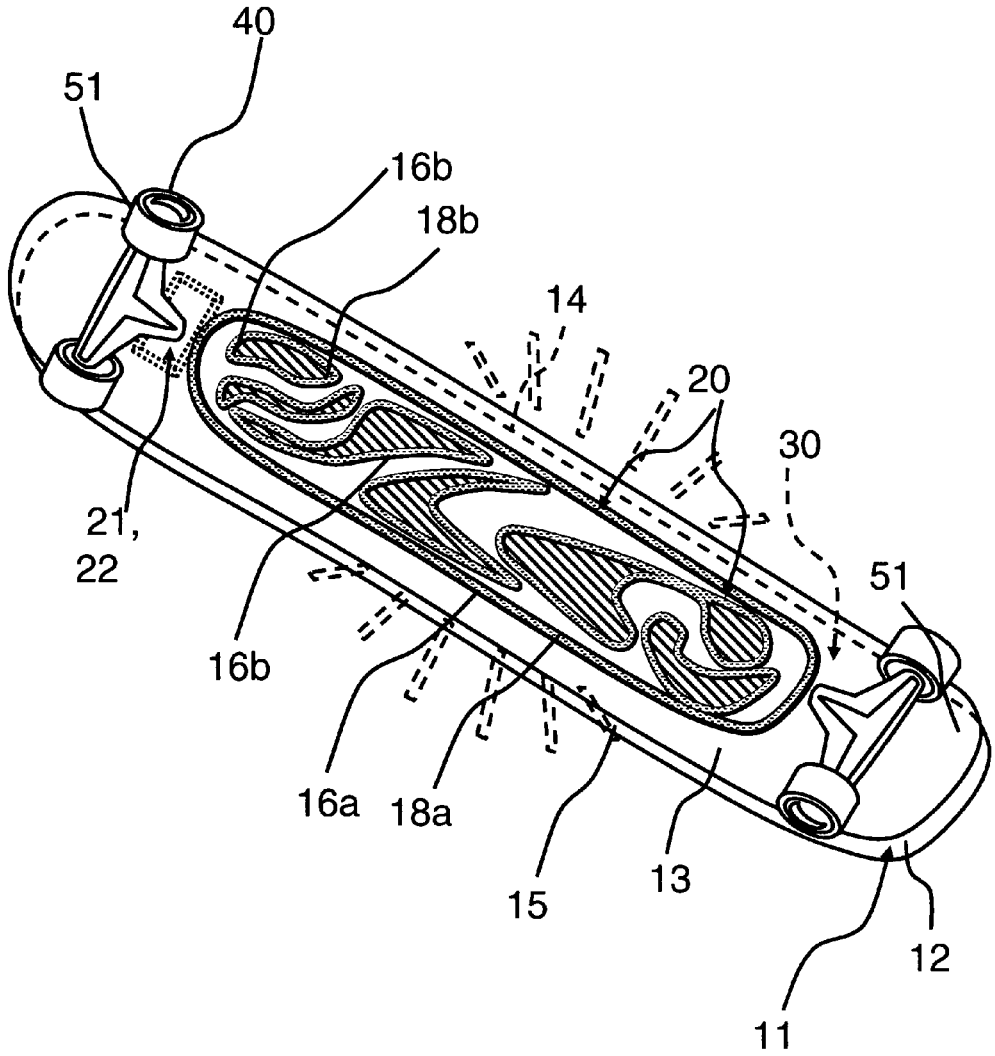
FIG. 1*b* is a bottom view of the board of FIG. 1 showing light emitting from the transparent segment of the base panel.
Figure 1C:
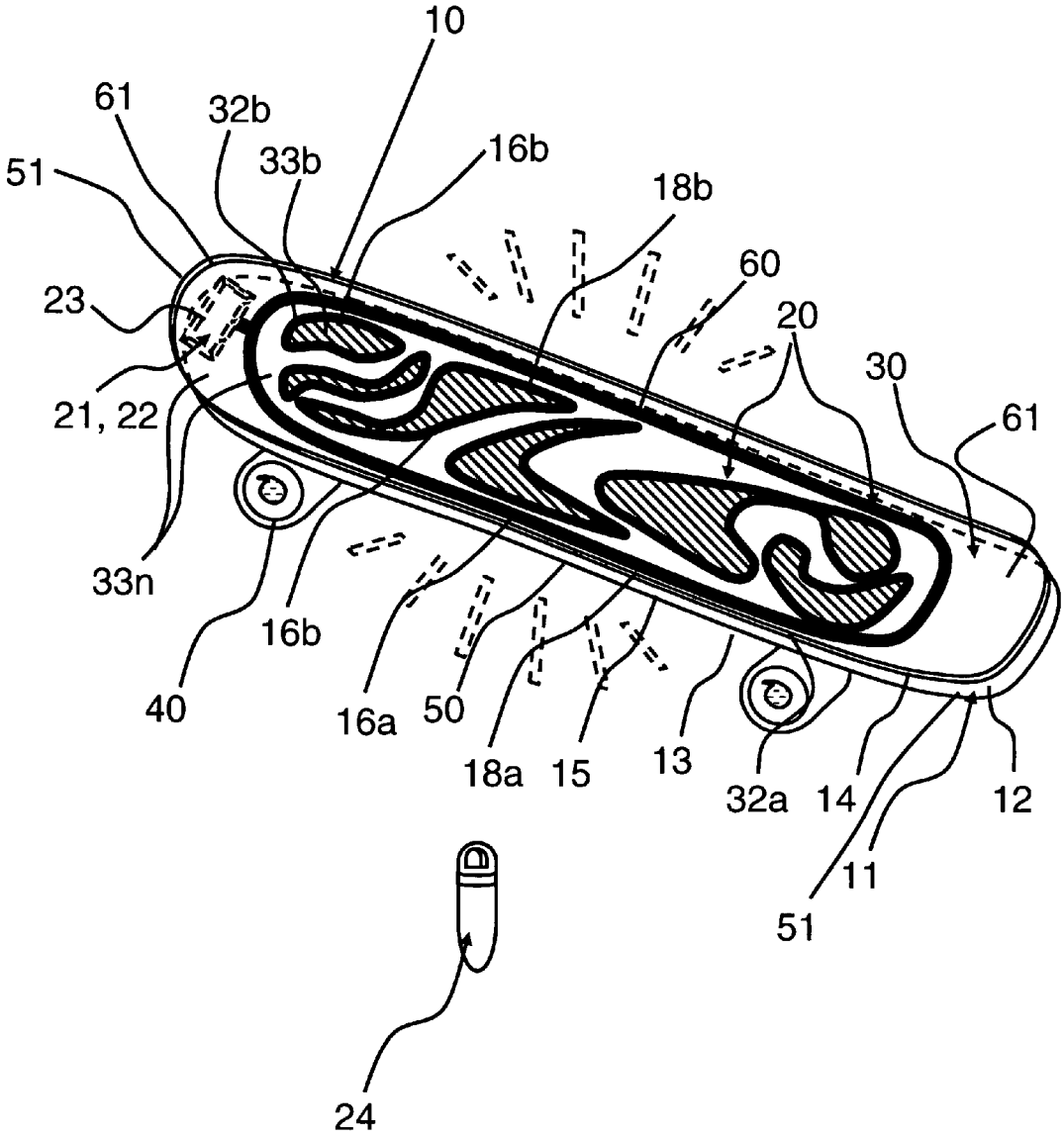
FIG. 1*c* is a top view of the sport board of FIG. 1 wherein the board is in the "off" condition.

FIGS. 1*a*-1*c* illustrate a schematic view of an embodiment of the sport board shown as a skateboard. Particularly: FIG. 1 shows a top view of the skateboard wherein the electroluminescent lighting source is supplied with current so that the board is in the "on" or illuminated condition, shown generally at 10; FIG. 1*b* shows a bottom view of the skateboard of FIG. 1 in the "on" condition; and FIG. 1*c* is a top view of the skateboard of FIG. 1 wherein the board is in the "off" condition. The illuminated sport board comprises a base panel 11 with sides 12, an underside surface 13, upper surface 14, and interior core 15. Upper surface 14 includes an opening therein that extends downward within interior core 15 of base panel 11 to form an inlay cavity 16*n* (16*a*-16*n*) therein. In this figure, inlay cavity 16 traverses throughout interior core 15 of base panel 11 and is shown as a design therein having an outer channel 16*a* and a plurality of smaller regions 16*b*. This inlay cavity 16*n* (16*a*-16*n*) may take a plethora of shapes and forms, but preferably it is a channel type construct and is formed within a substantial portion of interior core 15 of base panel 11. Underside surface 13 of base panel 11 has at least one transparent segment 18*a*, 18*b* (18*a*-18*n*) that is aligned with inlay cavity 16*n* (16*a*-16*n*). Base panel 11 may include a plurality of transparent segments 118*n*, or the entire body of base panel 11 may be substantially composed of a transparent material so that light can be emitted from virtually the entire base panel 11. The board further comprises an electroluminescent lighting source 20 housed within inlay cavity 16*a*, 16*b* (16*a*-16*n*) of base panel 11. Base panel 111 may be constructed so that sides 12 are composed of a transparent material so that electroluminescent lighting source 20 is further visible from sides 12 of base panel 11 during use.

Electroluminescent lighting source 20 may use different colored lights; the lights may be flashing, cascading (as in a timed sequence), constant, or a variety of these light patterns as would lend to enhanced safety. Electroluminescent light source 20 may comprise an electroluminescent sheet (preferably, double-sided), preferably having a width ranging between 2 to 27 inches and height ranging from 6 to 27 inches and can be cut into an array of designs and shaped to correspond to the inlay cavity 16. Alternatively, electroluminescent light source 20 comprises an electroluminescent cable and/or ribbon/tube positioned within inlay cavity 16; preferably, the cable and/or ribbon has a width of 0.025 to 24 inches.

A battery 21 activated by a power control 22 is attached to electroluminescent light source 20 within base panel 11 for supplying current to electroluminescent light source 20. Power control 22 may be activated by a pressure sensor/plurality of pressure sensors located within base panel 11 for supplying current to electroluminescent light source 20. That way, the user merely steps on board 10 and the light 20 begins to emit; conversely, when the user steps off the board, the light 20 turns off. A light sensor may be provided to engage power control 22 and battery 21 for automatically activating/deactivating current supply to electroluminescent light source 20 so that the light 20 turns on when it becomes dim and automatically turns off in daylight. Alternatively, power control 22 may be provided with an on/off power switch having a top covering closable in a substantially sealed manner within base panel 11. Most preferably, power control 22 attached to battery 21 may be integrated within a card reader 23 which is activated by a key 24 with an internal card tag/bar code, which in turn activates battery 21 for supplying current to electroluminescent light source 20. The use of the card reader 23 is advantageous in that it provides instant activation of the current to the lighting source 20 without concern for water affecting the board or power control 22.

A top shell 30 having at least one transparent display 32 (32*a*-32*n*) is attached to base panel 11 to form board 10. Top shell 30 preferably further comprises a non-skid surface applied thereto for increased traction thereon. Preferably, base panel 11 and top shell 30 are both composed of, or substantially composed of, a transparent, abrasion resistant material. Base panel 11 and top shell 30 may be composed of/or include portions composed of a durable material, such as a polymeric material, titanium, and/or Kevlar. In turn, preferably top shell 30 includes a plurality of transparent displays 32*n* (32*a*-32*n*) and opaque sections 33 (33*a*-33*n*) dispersed on top shell 30 so that a substantial portion of top shell 30 is covered with transparent displays 32*a*-32*n* intermingled with opaque sections 33*a*-33*n*. The transparent displays 32*a*-32*n* are optionally tinted or painted with at least one transparent pigment to allow light to pass through and opaque sections 33 (33*a*-33*n*) are preferably tinted or painted with at least one opaque pigment to prevent light from passing through. Preferably, base panel 11 and top shell 30 include a flat body section 50, 60 and curved end sections 51, 61, arranged so that the inlay cavity 16 and visa vie electroluminescent lighting source 20 is inlaid within flat body section 50 of base panel 11; in turn, transparent displays 32*a*-32*n* are located on flat body section 60 of top shell 30.

Top shell 30 is attached to upper surface 14 of base panel 11 so that transparent displays 32*n* (32*a*-32*n*) are aligned with electroluminescent lighting strip 20 within inlay cavity 16*a*, 16*b* (16*a*-16*n*) for emitting light from transparent displays 32*a*, 32*b* (32*a*-32*n*). The electroluminescent lighting source emits light through transparent displays 32*a*, 32*b* (32*a*-32*n*) of top shell 30 and transparent segments 18*a*, 18*b* (18*a*-18*n*) of underside surface 13 of base panel 11 so that skateboard 10 is highly visible. The illuminated sport board may further include wheels 40 attached to underside surface 13 of base panel 11. Alternatively, the sport board may be constructed for use as a snowboard or for use as skis.

Inlay cavity 16 can be a plethora of shapes and sizes, and may include large regions within interior core 15 of base panel 11. Transparent displays 32*a*-32*n* can be a plethora of shapes, sizes, designs, characters, indicia, and so on. Transparent displays 32*a*-32*n* may be specific characters and advertise various organizations. Moreover, opaque sections 33*a*-33*n* and transparent designs 32*a*-32*n* may be of any size, and may merely be speckles located along the entire surface of top shell 30 to look like an egg or the like with light radiating from every angle along the shaped of top shell 30. Additionally, a retroreflective sheet thermally bonded to a woven or knitted strip may be bonded to portions of base panel 11 and top shell 30 to provide reflective properties, as well as illumination to the illuminated sport board 10. Preferably, this retroreflective sheet should be bonded to sides 12 of base panel 11 and dispersed on top shell 30.

Figure 2A:
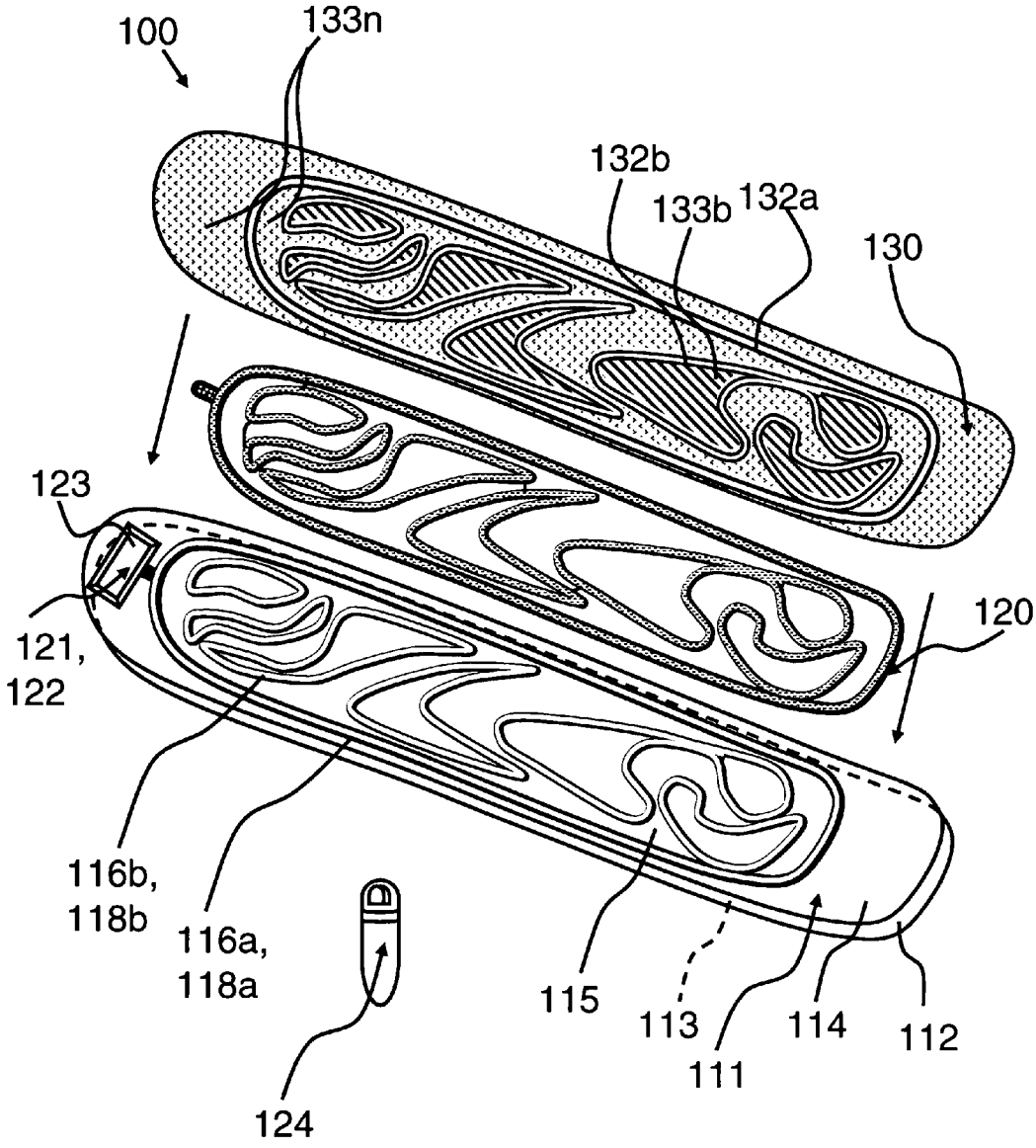
FIG. 2*a* is a schematic view showing the omnidirectionally illuminated sports board being assembled, wherein the inlay cavity resembles a series of channels in the base panel.

FIG. 2*a* is a schematic view showing generally at 100 the omnidirectionally illuminated sports board being assembled. The first step involves forming a base panel 111 having sides 112, an underside surface 113, upper surface 114, and interior core 115. Underside 113 has at least one transparent segment 118*a*, 118*b* (118*a*-118*n*) aligned with an inlay cavity 116*n* (116*a*-116*n*) created from a plethora of illumination designs, herein resembling an interconnected channel. An electroluminescent lighting strip 120 is sized and shaped to correspond with the illumination designs of inlay cavity 116*n* (116*a*-116*n*) and same is placed within inlay cavity 116*n* (116*a*-116*n*) of base panel 111. A battery 121 with a power control 122 is formed within base panel 111 and connecting to electroluminescent lighting strip 120 for supplying current thereto. Preferably, power control 122 attached to battery 121 may be integrated within a card reader 123 which is activated by a key 124 with an internal card tag/bar code, which in turn activates battery 121 for supplying current to electroluminescent light source 120. Subsequently, a top shell 130 having at least one transparent display 32*a*-32*n* shaped as the illumination designs of inlay cavity 116*n* (116*a*-116*n*) is attached to base panel 111 in a substantially sealed condition. This top shell 130 is aligned with base panel 111 and visa vie transparent displays 132*n* (132*a*-132*n*) are aligned with inlay cavity 116*n* (116*a*-116*n*) and electroluminescent light strip 120. In operation, electroluminescent lighting source 120 emits light through transparent displays 32*a*-32*n* of top shell 130 and transparent segments 118*a*-118*n* of underside surface 113 of base panel 111 so that the sport board is highly visible from both top and bottom views.

Figure 2B:
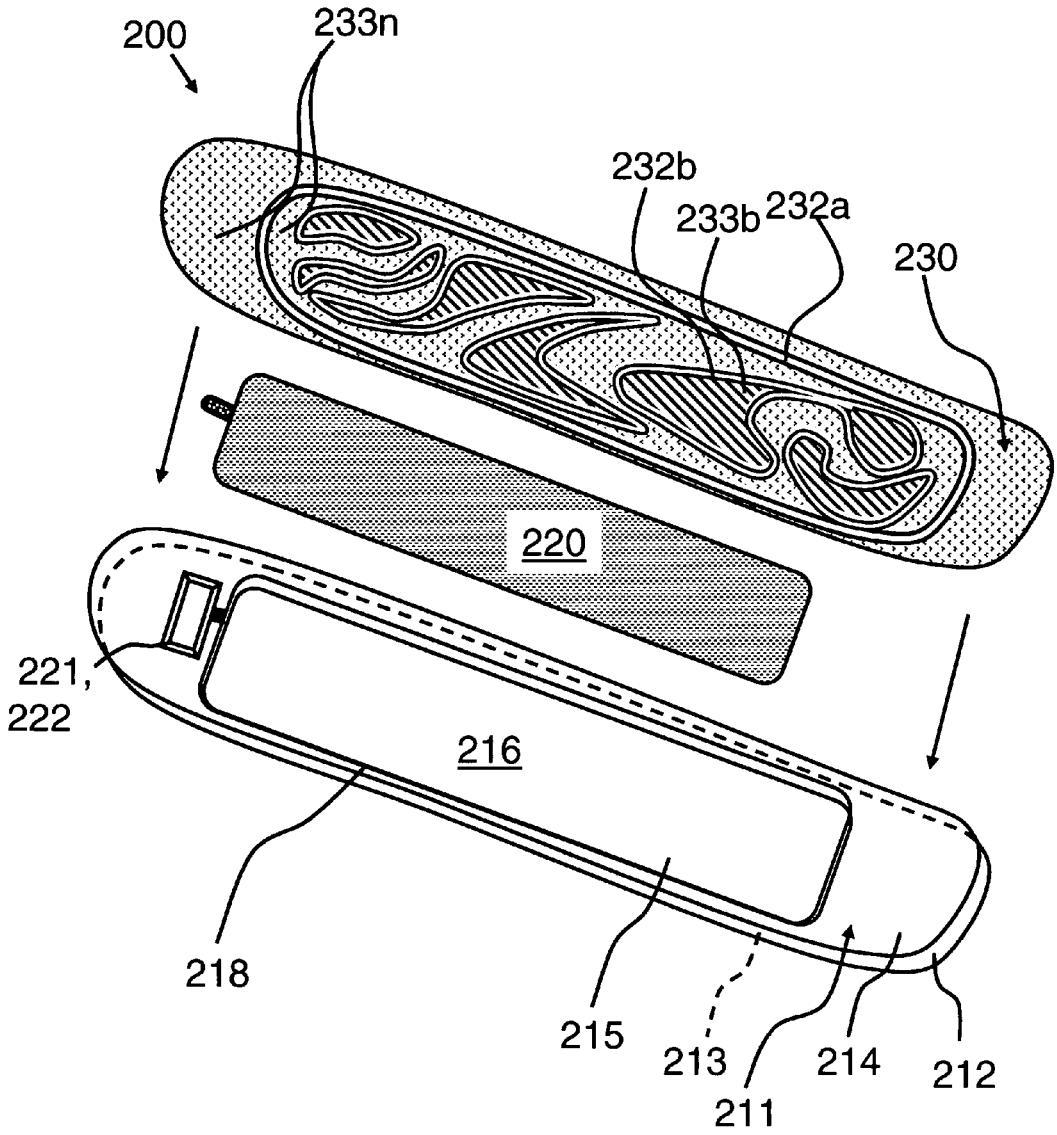
FIG. 2*b* is a schematic view showing another embodiment of the omnidirectionally illuminated sports board being assembled, wherein the inlay cavity is a large insert in the base panel.

FIG. 2*b* is a schematic view showing another embodiment of the omnidirectionally illuminated sports board being assembled, wherein the inlay cavity is a large insert in the base panel, shown generally at 200. Base panel 211 with sides 212, underside surface 213, upper surface 214, and interior core 215 includes at least one transparent segment 218 (218*a*-218*n*) which herein is a rectangular shaped segment. This transparent segment 218 is aligned with an inlay cavity 216 (216*a*-216*n*) created from a plethora of illumination designs, herein resembling a large rectangular cut-out. An electroluminescent lighting strip 220 is sized and shaped to correspond with the illumination designs of inlay cavity 216 and same is placed therewithin. A battery 221 with a power control 222 is formed within base panel 211 and coupled to electroluminescent lighting strip 220 for supplying current thereto. Top shell 230 having at least one transparent display 232*a*-232*n* shaped as the illumination designs of inlay cavity 216 is attached to base panel 211 in a substantially sealed condition.

Having thus described the invention in rather full detail, it will be understood that such detail need not be strictly adhered to, but that additional changes and modifications may suggest themselves to one skilled in the art. For example, the light emitting diodes and/or electroluminescent lighting strips or electroluminescent wire can be sequenced intermittently to generate moving light, thereby creating an ever changing kaleidoscope of light movement. Such changes and modifications are intended to falling within the scope of the invention as defined by the subjoined claims.

What is claimed is:

1. An illuminated sport board comprising:

a. a base panel having sides, an underside surface, upper surface, and interior core, said upper surface having an opening therein that extends within said interior core of said base panel to form an inlay cavity therein, said underside having at least one transparent segment being aligned with said inlay cavity;

b. an electroluminescent lighting source housed within said inlay cavity of said base panel;

c. a top shell having at least one transparent display, wherein said top shell is attached to said upper surface of said base panel so that said transparent display is aligned with said electroluminescent lighting strip within said inlay cavity for emitting light from said transparent display;

d. a battery activated by a power control for supplying current to said electroluminescent light source; and e. said power control attached to said battery includes a card reader, and a key includes a card tag that activates said card reader, which in turn activates said power control for supplying current to said electroluminescent light source;

whereby said electroluminescent lighting source emits light through said transparent display of said top shell and said transparent segment of said underside surface of said base panel so that said sport board is highly visible.

2. An illuminated sport board as recited by claim 1 comprising wheels attached to said underside surface of said base panel to form a skateboard device.

3. An illuminated sport board as recited by claim 1, wherein said sport board is constructed for use as a snowboard or skis.

4. An illuminated sport board as recited by claim 1, wherein said base panel is composed of a transparent material.

5. An illuminated sport board as recited by claim 1, wherein said sides of said base panel are composed of a transparent material so that said electroluminescent lighting source is further visible from said sides of said base panel of said sport board.

6. An illuminated sport board as recited by claim 1, wherein said top shell comprises a non-skid surface applied thereto for increased traction.

7. An illuminated sport board as recited by claim 1, wherein said base panel and said top shell are composed of a transparent, abrasion resistant material.

8. An illuminated sport board as recited by claim 1, wherein said top shell includes a plurality of said transparent displays associated with a plurality of opaque sections.

9. An illuminated sport board as recited by claim 1, wherein said base panel and said top shell include a flat body section and curved end sections, and wherein said electroluminescent lighting source is inlaid within said flat body section.

10. An illuminated sport board as recited by claim 1, wherein said base panel and said top shell are composed or include portions composed of a durable material.

11. An illuminated sport board as recited by claim 1 comprising a light sensor engaged with said battery for automatically activating/deactivating said current supply to said electroluminescent light source.

12. An illuminated sport board as recited by claim 1, wherein said electroluminescent light source comprises an electroluminescent sheet.

13. An illuminated sport board as recited by claim 1, wherein said electroluminescent light source comprises an electroluminescent cable and/or ribbon positioned within said inlay cavity of said base panel.

14. A process for manufacture of an illuminated sport board, comprising the steps of:

a. forming a base panel having sides, an underside surface, upper surface, and interior core, said underside having at least one transparent segment being aligned with said inlay cavity b. selecting illumination designs and aligning said illumination designs on said upper surface for forming an opening therein and an inlay cavity, said inlay cavity being aligned with said transparent segment of said base panel;

c. forming an inlay cavity within said upper surface and said interior core of said base panel shaped as said illumination designs;

d. sizing and shaping an electroluminescent lighting strip to correspond with said illumination designs of said inlay cavity and placing said electroluminescent lighting strip within said inlay cavity of said base panel;

e. cutting a compartment into said interior core of said base panel and fitting a battery with a power control therein and connecting same to said electroluminescent strip;

f. forming a top shell having at least one transparent display shaped as said illumination designs;

g. aligning said transparent display on said top shell with said electroluminescent light strip within said inlay cavity;

h. attaching said top shell to said base panel;

whereby said electroluminescent lighting source emits light through said transparent display of said top shell and said transparent segment of said underside surface of said base panel so that said sport board is highly visible.

15. An illuminated sport board comprising:

a. a base panel having sides, an underside surface, upper surface, and interior core, said upper surface having an opening therein that extends within said interior core of said base panel to form an inlay cavity therein, said underside having at least one transparent segment being aligned with said inlay cavity;

b. an electroluminescent lighting source housed within said inlay cavity of said base panel;

c. a top shell having at least one transparent display, wherein said top shell is attached to said upper surface of said base panel so that said transparent display is aligned with said electroluminescent lighting strip within said inlay cavity for emitting light from said transparent display;

d. a battery activated by a power control for supplying current to said electroluminescent light source; and e. said power control attached to said battery being activated by a pressure sensor located within said base panel for supplying current to said electroluminescent light source;

whereby said electroluminescent lighting source emits light through said transparent display of said top shell and said transparent segment of said underside surface of said base panel so that said sport board is highly visible.

16. An illuminated sport board as recited by claim 15 comprising wheels attached to said underside surface of said base panel to form a skateboard device.

17. An illuminated sport board as recited by claim 15, wherein said sport board is constructed for use as a snowboard or skis.

18. An illuminated sport board as recited by claim 15, wherein said sides of said base panel are composed of a transparent material so that said electroluminescent lighting source is further visible from said sides of said base panel of said sport board.

19. An illuminated sport board as recited by claim 15, wherein said top shell comprises a non-skid surface applied thereto for increased traction.

20. An illuminated sport board as recited by claim 15, wherein said base panel is composed of a transparent material.

21. An illuminated sport board as recited by claim 15, wherein said base panel and said top shell are composed of a transparent, abrasion resistant material.

22. An illuminated sport board as recited by claim 15, wherein said top shell includes a plurality of said transparent displays associated with a plurality of opaque sections.

23. An illuminated sport board as recited by claim 15, wherein said base panel and said top shell include a flat body section and curved end sections, and wherein said electroluminescent lighting source is inlaid within said flat body section.

24. An illuminated sport board as recited by claim 15, wherein said base panel and said top shell are composed or include portions composed of a durable material.

25. An illuminated sport board as recited by claim 15 comprising a light sensor engaged with said battery for automatically activating/deactivating said current supply to said electroluminescent light source.

26. An illuminated sport board as recited by claim 15, wherein said electroluminescent light source comprises an electroluminescent sheet.

27. An illuminated sport board as recited by claim 15, wherein said electroluminescent light source comprises an electroluminescent cable and/or ribbon positioned within said inlay cavity of said base panel.

28. An illuminated sport board comprising:

a. a base panel having sides, an underside surface, upper surface, and interior core, said upper surface having an opening therein that extends within said interior core of said base panel to form an inlay cavity therein, said underside having at least one transparent segment being aligned with said inlay cavity;

b. an electroluminescent lighting source housed within said inlay cavity of said base panel;

c. a top shell having at least one transparent display, wherein said top shell is attached to said upper surface of said base panel so that said transparent display is aligned with said electroluminescent lighting strip within said inlay cavity for emitting light from said transparent display;

d. a battery activated by a power control for supplying current to said electroluminescent light source; and e. a retroreflective sheet thermally bonded to a woven or knitted strip which in turn is bonded to portions of said base panel and said top shell to provide reflective properties as well as illumination to said illuminated sport board;

whereby said electroluminescent lighting source emits light through said transparent display of said top shell and said transparent segment of said underside surface of said base panel so that said sport board is highly visible.

29. An illuminated sport board as recited by claim 28, wherein said power control attached to said battery includes a card reader and a key is provided including a card tag that activates said card reader, which in turn activates said power control for supplying current to said electroluminescent light source.

30. An illuminated sport board as recited by claim 28, wherein said power control attached to said battery is activated by a pressure sensor located within said base panel for supplying current to said electroluminescent light source.

31. An illuminated sport board as recited by claim 28, wherein said power control attached to said battery includes an on/off power switch having a top covering closable in a substantially sealed manner within said base panel.

* * * * *